US007488130B2

(12) United States Patent
Dylkiewicz et al.

(10) Patent No.: US 7,488,130 B2
(45) Date of Patent: Feb. 10, 2009

(54) SEAL ASSEMBLY FOR RETRACTABLE INSTRUMENT

(75) Inventors: David A. Dylkiewicz, Lockport, IL (US); Robert G. Challman, Naperville, IL (US)

(73) Assignee: Sanford, L.P., Oak Brook, IL (US)

( * ) Notice: Subject to any disclaimer, the term of this patent is extended or adjusted under 35 U.S.C. 154(b) by 0 days.

(21) Appl. No.: 11/701,231

(22) Filed: Feb. 1, 2007

(65) Prior Publication Data

US 2008/0187389 A1 Aug. 7, 2008

(51) Int. Cl.
*B43K 9/00* (2006.01)

(52) U.S. Cl. ..... 401/108; 401/107

(58) Field of Classification Search ..... 401/107, 401/108, 245

See application file for complete search history.

(56) References Cited

U.S. PATENT DOCUMENTS

| | | | |
|---|---|---|---|
| 1,810,249 | A | 6/1931 | Koehler |
| 1,940,548 | A | 12/1933 | Jensen |
| 2,291,859 | A | 8/1942 | Andrews |
| 2,392,840 | A | 1/1946 | Groft |
| 2,401,711 | A | 6/1946 | Smith |
| 2,603,186 | A | 7/1952 | Fischer |
| 2,626,049 | A | 1/1953 | Tursky |
| 2,874,679 | A | 2/1959 | Zepelovitch |
| 2,949,887 | A | 8/1960 | Martin et al. |
| 2,957,452 | A | 10/1960 | Brannon |
| 3,035,299 | A | 5/1962 | Gordon et al. |
| 3,124,106 | A | 3/1964 | Kosta |
| 3,146,758 | A | 9/1964 | Zepell |
| 3,169,511 | A | 2/1965 | Spatz |
| 3,480,370 | A | 11/1969 | Koeln |
| 3,525,573 | A * | 8/1970 | Fend ..... 401/108 |
| 3,583,820 | A | 6/1971 | Koeln |
| 3,594,091 | A | 7/1971 | Bleuer |
| 3,617,138 | A | 11/1971 | Fukui et al. |

(Continued)

FOREIGN PATENT DOCUMENTS

| | | |
|---|---|---|
| DE | 34 38 074 | 4/1986 |

(Continued)

OTHER PUBLICATIONS

Photograph A, Boone Marker, capped.

(Continued)

*Primary Examiner*—Huyen Le
(74) *Attorney, Agent, or Firm*—Marshall, Gerstein & Borun LLP

(57) ABSTRACT

A seal assembly for a retractable instrument having an applicator element is disclosed, the seal assembly comprising a base, at least two fingers attached to the base, and a sleeve surrounding the base. When the retractable instrument is in a retracted position, the sleeve constrains the fingers such that the fingers are in a fully closed state and seal the applicator element. Protraction of the base relative to the sleeve allows the fingers to open, thereby exposing the applicator element. Thus, the seal assembly opens to expose an applicator element such that the applicator element is in an application position; however, none of the elements of the seal assembly contacts the applicator element to transfer fluid from the applicator element, thereby eliminating potential degradation of the seal.

20 Claims, 7 Drawing Sheets

U.S. PATENT DOCUMENTS

| | | | | |
|---|---|---|---|---|
| 3,637,316 | A | | 1/1972 | Bross et al. |
| 3,733,139 | A | | 5/1973 | Neidhardt et al. |
| 3,813,176 | A | | 5/1974 | Kamo |
| 3,895,632 | A | | 7/1975 | Plowiecki et al. |
| 3,941,488 | A | | 3/1976 | Maxwell |
| 3,944,371 | A | | 3/1976 | Schenk |
| 3,945,734 | A | | 3/1976 | Woodbridge |
| 3,955,893 | A | | 5/1976 | Pulaski |
| 3,985,455 | A | | 10/1976 | Wahlberg |
| 4,022,535 | A | | 5/1977 | Ritter |
| 4,115,015 | A | | 9/1978 | Torii et al. |
| 4,161,374 | A | | 7/1979 | Koeln et al. |
| 4,177,814 | A | | 12/1979 | Knepshield et al. |
| 4,218,154 | A | | 8/1980 | Erfer |
| 4,221,490 | A | | 9/1980 | Malm |
| 4,269,525 | A | | 5/1981 | Melikian |
| 4,315,695 | A | | 2/1982 | Alves dos Santos et al. |
| 4,318,340 | A | | 3/1982 | Shenoha et al. |
| 4,469,462 | A | | 9/1984 | Hashimoto et al. |
| 4,479,732 | A | | 10/1984 | Shimizu et al. |
| 4,533,271 | A | | 8/1985 | Sansevero |
| 4,540,300 | A | * | 9/1985 | Midorikawa ..... 401/107 |
| 4,549,827 | A | | 10/1985 | Mack |
| 4,560,297 | A | | 12/1985 | Leem |
| 4,575,271 | A | | 3/1986 | Hashimoto et al. |
| 4,580,918 | A | | 4/1986 | Baker et al. |
| 4,618,280 | A | | 10/1986 | Kageyama et al. |
| 4,629,348 | A | | 12/1986 | Hashimoto et al. |
| 4,711,592 | A | | 12/1987 | Gregory |
| 4,738,724 | A | | 4/1988 | Wittwer et al. |
| 4,738,817 | A | | 4/1988 | Wittwer et al. |
| 4,759,650 | A | | 7/1988 | Granoff |
| 4,768,529 | A | | 9/1988 | Mahruki et al. |
| 4,812,299 | A | | 3/1989 | Wason |
| 4,815,881 | A | | 3/1989 | Chern |
| 4,859,103 | A | | 8/1989 | Wittek et al. |
| 4,863,796 | A | | 9/1989 | Wason |
| 4,879,058 | A | | 11/1989 | Wason |
| 4,879,323 | A | | 11/1989 | Wason |
| 4,896,983 | A | | 1/1990 | Im et al. |
| 4,902,657 | A | | 2/1990 | Wason |
| 4,902,729 | A | | 2/1990 | Wason |
| 4,904,101 | A | | 2/1990 | Petterson |
| 4,911,570 | A | | 3/1990 | Rhoades |
| 4,933,387 | A | | 6/1990 | Wason |
| 4,937,078 | A | | 6/1990 | Mezei et al. |
| 4,954,468 | A | | 9/1990 | Wason |
| 4,968,728 | A | | 11/1990 | Wason |
| 4,969,764 | A | * | 11/1990 | Gregory ..... 401/108 |
| 4,974,980 | A | | 12/1990 | Gueret et al. |
| 5,015,111 | A | | 5/1991 | Petterson |
| 5,022,773 | A | | 6/1991 | Waldinger et al. |
| 5,026,189 | A | | 6/1991 | Keil et al. |
| 5,048,990 | A | | 9/1991 | Hashimoto et al. |
| 5,090,955 | A | | 2/1992 | Simon |
| D324,542 | S | | 3/1992 | Lin |
| 5,092,701 | A | | 3/1992 | Lai et al. |
| 5,174,814 | A | | 12/1992 | Burwell et al. |
| 5,184,908 | A | | 2/1993 | Yamamoto et al. |
| 5,207,523 | A | | 5/1993 | Wittek |
| 5,336,006 | A | | 8/1994 | Badr et al. |
| 5,342,135 | A | | 8/1994 | Tucker |
| 5,342,136 | A | | 8/1994 | Fukami et al. |
| 5,358,864 | A | | 10/1994 | van den Broeck et al. |
| 5,372,580 | A | | 12/1994 | Simon et al. |
| 5,420,615 | A | | 5/1995 | Witz et al. |
| 5,426,456 | A | | 6/1995 | Kuelzer et al. |
| 5,439,626 | A | | 8/1995 | Bennett et al. |
| 5,454,655 | A | | 10/1995 | Chiswell |
| 5,517,218 | A | | 5/1996 | Lehna et al. |
| 5,547,301 | A | | 8/1996 | Kageyama et al. |
| 5,547,468 | A | | 8/1996 | Simon et al. |
| 5,553,956 | A | | 9/1996 | Mitsuya et al. |
| 5,599,122 | A | | 2/1997 | Yu |
| 5,604,036 | A | | 2/1997 | Price et al. |
| 5,605,402 | A | | 2/1997 | Uggetti et al. |
| 5,607,437 | A | | 3/1997 | Simon et al. |
| 5,610,046 | A | | 3/1997 | van Ooyen et al. |
| 5,643,660 | A | | 7/1997 | Price et al. |
| 5,651,627 | A | | 7/1997 | Dowzall et al. |
| 5,653,725 | A | | 8/1997 | Simon et al. |
| 5,672,021 | A | | 9/1997 | Abber et al. |
| 5,676,481 | A | | 10/1997 | Nicoll et al. |
| 5,813,787 | A | | 9/1998 | Dowzall et al. |
| 5,823,697 | A | | 10/1998 | Talbot et al. |
| D400,581 | S | | 11/1998 | Hasegawa |
| 5,829,904 | A | | 11/1998 | Matsumoto et al. |
| 5,849,559 | A | | 12/1998 | Van Der Wouw et al. |
| 5,855,442 | A | | 1/1999 | Keller |
| 5,865,553 | A | | 2/1999 | Flye Sainte Marie et al. |
| 5,871,294 | A | | 2/1999 | Turner |
| 5,871,296 | A | | 2/1999 | Furukawa et al. |
| 5,891,398 | A | | 4/1999 | Lewis et al. |
| 5,899,618 | A | | 5/1999 | Kobayashi et al. |
| 5,906,446 | A | | 5/1999 | McCulloch et al. |
| 5,915,867 | A | | 6/1999 | Hashimoto et al. |
| 5,927,881 | A | | 7/1999 | Yang |
| 5,927,882 | A | | 7/1999 | Kageyama et al. |
| 5,927,883 | A | | 7/1999 | Lebauer |
| 5,929,051 | A | | 7/1999 | Ni et al. |
| 5,931,846 | A | | 8/1999 | Simon et al. |
| 5,957,603 | A | | 9/1999 | Bell |
| 5,961,703 | A | | 10/1999 | Fraas et al. |
| 5,967,688 | A | | 10/1999 | Hu et al. |
| D417,206 | S | | 11/1999 | Hirota |
| 6,019,535 | A | | 2/2000 | Turner |
| 6,027,271 | A | | 2/2000 | Barosso et al. |
| 6,033,141 | A | | 3/2000 | Blaustein et al. |
| 6,048,121 | A | | 4/2000 | Carver |
| 6,066,356 | A | | 5/2000 | Van Der Wouw et al. |
| 6,089,776 | A | | 7/2000 | Kaufmann et al. |
| 6,095,707 | A | | 8/2000 | Kaufmann et al. |
| 6,099,924 | A | | 8/2000 | Nakamaki et al. |
| 6,106,179 | A | | 8/2000 | Kuo |
| 6,120,204 | A | | 9/2000 | Rigoni |
| 6,120,751 | A | | 9/2000 | Unger |
| 6,135,660 | A | | 10/2000 | Stevens et al. |
| 6,155,733 | A | | 12/2000 | Holbrook et al. |
| 6,158,913 | A | | 12/2000 | Dumler et al. |
| 6,170,318 | B1 | | 1/2001 | Lewis |
| 6,213,661 | B1 | | 4/2001 | Coon |
| 6,231,257 | B1 | | 5/2001 | Stevens et al. |
| 6,244,744 | B1 | | 6/2001 | Calvin |
| 6,244,774 | B1 | | 6/2001 | Barosso et al. |
| 6,261,019 | B1 | | 7/2001 | Furukawa et al. |
| D446,213 | S | | 8/2001 | Chen et al. |
| 6,306,598 | B1 | | 10/2001 | Charych et al. |
| 6,347,898 | B1 | | 2/2002 | Rhodes et al. |
| 6,350,369 | B1 | | 2/2002 | Lewis et al. |
| 6,371,673 | B1 | | 4/2002 | Gueret |
| D457,185 | S | | 5/2002 | Ham |
| 6,409,408 | B2 | | 6/2002 | Koyama et al. |
| D460,484 | S | | 7/2002 | Bianco, Jr. |
| D460,982 | S | | 7/2002 | Bianco, Jr. |
| 6,416,242 | B1 | | 7/2002 | Kaufmann et al. |
| 6,417,121 | B1 | | 7/2002 | Newkirk et al. |
| 6,417,122 | B1 | | 7/2002 | Newkirk et al. |
| 6,420,285 | B1 | | 7/2002 | Newkirk et al. |
| 6,433,012 | B1 | | 8/2002 | Tuse et al. |
| 6,468,759 | B1 | | 10/2002 | Charych |
| 6,478,495 | B2 | | 11/2002 | Ami et al. |
| 6,482,517 | B1 | | 11/2002 | Anderson |
| 6,505,984 | B2 | | 1/2003 | Smith et al. |
| D471,233 | S | | 3/2003 | Geiselhart et al. |

| | | | |
|---|---|---|---|
| D472,578 | S | 4/2003 | Plantz et al. |
| 6,540,422 | B2 | 4/2003 | Torii |
| 6,554,516 | B1 | 4/2003 | Christopher |
| 6,554,517 | B2 | 4/2003 | Ahmed |
| 6,561,713 | B2 | 5/2003 | Sukhna et al. |
| 6,565,275 | B2 | 5/2003 | Brand et al. |
| 6,565,763 | B1 | 5/2003 | Asakawa et al. |
| 6,588,958 | B1 | 7/2003 | Seidler |
| 6,605,344 | B1 | 8/2003 | Ohba et al. |
| 6,607,325 | B2 | 8/2003 | Hori et al. |
| 6,631,333 | B1 | 10/2003 | Lewis et al. |
| 6,638,621 | B2 | 10/2003 | Anderson |
| 6,644,880 | B2 | 11/2003 | Duez et al. |
| 6,648,539 | B2 | 11/2003 | Dai et al. |
| 6,656,319 | B1 | 12/2003 | Boyd et al. |
| D487,113 | S | 2/2004 | Kent |
| D489,087 | S | 4/2004 | Kent |
| 6,723,394 | B1 | 4/2004 | Sirringhaus et al. |
| 6,752,557 | B1 | 6/2004 | Hsieh et al. |
| 6,755,584 | B2 | 6/2004 | O'Brien et al. |
| D497,180 | S | 10/2004 | Cetera |
| D497,387 | S | 10/2004 | Cetera |
| D501,509 | S | 2/2005 | Lecce |
| 6,927,256 | B2 | 8/2005 | Stevens et al. |
| 6,964,534 | B2 | 11/2005 | Brand et al. |
| 6,967,102 | B1 | 11/2005 | Anderson et al. |
| 6,974,697 | B2 | 12/2005 | Comer et al. |
| 6,977,244 | B2 | 12/2005 | Tormo et al. |
| 6,979,456 | B1 | 12/2005 | Parikh et al. |
| 6,979,558 | B2 | 12/2005 | Harris, Jr. et al. |
| 6,979,559 | B2 | 12/2005 | Harris, Jr. et al. |
| 6,981,812 | B1 | 1/2006 | Hsieh et al. |
| 6,989,007 | B2 | 1/2006 | Shadduck |
| 6,989,195 | B2 | 1/2006 | Anderson |
| 6,991,514 | B1 | 1/2006 | Meloni et al. |
| 7,004,945 | B2 | 2/2006 | Boyd et al. |
| 7,008,633 | B2 | 3/2006 | Yang et al. |
| 7,018,838 | B2 | 3/2006 | Murphy et al. |
| 7,022,683 | B1 | 4/2006 | Ni et al. |
| 7,037,015 | B1 | 5/2006 | Witz et al. |
| 7,037,657 | B2 | 5/2006 | Le et al. |
| 7,048,963 | B2 | 5/2006 | Braithwaite et al. |
| 7,059,796 | B2 | 6/2006 | Lewis, Jr. et al. |
| 7,060,754 | B2 | 6/2006 | Stevens et al. |
| 7,101,102 | B2 | 9/2006 | Sawa et al. |
| 7,329,062 | B2 | 2/2008 | Brand et al. |
| 7,350,996 | B2 | 4/2008 | Bielecki et al. |
| 2002/0010510 | A1 | 1/2002 | Silvestrini |
| 2002/0029084 | A1 | 3/2002 | Paul et al. |
| 2002/0081139 | A1 | 6/2002 | Legg |
| 2002/0081232 | A1 | 6/2002 | Lewis et al. |
| 2002/0131807 | A1 | 9/2002 | Ami et al. |
| 2002/0142477 | A1 | 10/2002 | Lewis et al. |
| 2002/0159817 | A1 | 10/2002 | Brand et al. |
| 2002/0159818 | A1 | 10/2002 | Smith et al. |
| 2002/0172544 | A1 | 11/2002 | Dai |
| 2002/0192007 | A1 | 12/2002 | Lee |
| 2003/0068191 | A1 | 4/2003 | Hori |
| 2003/0108377 | A1 | 6/2003 | Duez et al. |
| 2003/0108743 | A1 | 6/2003 | Anderson |
| 2003/0138283 | A1 | 7/2003 | O'Brien et al. |
| 2003/0195300 | A1 | 10/2003 | Stevens et al. |
| 2003/0210945 | A1 | 11/2003 | Noguchi |
| 2003/0210947 | A1 | 11/2003 | Calendrille et al. |
| 2003/0211130 | A1 | 11/2003 | Sanders et al. |
| 2003/0215281 | A1 | 11/2003 | Sexton et al. |
| 2003/0222048 | A1 | 12/2003 | Asakawa et al. |
| 2004/0028875 | A1 | 2/2004 | Van Rijn et al. |
| 2004/0037609 | A1 | 2/2004 | Kageyama |
| 2004/0050816 | A1 | 3/2004 | Asakawa et al. |
| 2004/0062879 | A1 | 4/2004 | Bowman et al. |
| 2004/0201117 | A1 | 10/2004 | Anderson |
| 2004/0213627 | A1 | 10/2004 | Marschand et al. |
| 2004/0265035 | A1 | 12/2004 | Brand et al. |
| 2004/0265039 | A1 | 12/2004 | Buck |
| 2005/0004578 | A1 | 1/2005 | Lambrecht et al. |
| 2005/0019112 | A1 | 1/2005 | Erickson et al. |
| 2005/0043470 | A1 | 2/2005 | Stevens et al. |
| 2005/0047844 | A1 | 3/2005 | Lammers et al. |
| 2005/0074268 | A1 | 4/2005 | Beil |
| 2005/0079003 | A1 | 4/2005 | Buck et al. |
| 2005/0084320 | A1 | 4/2005 | Carroll |
| 2005/0084321 | A1 | 4/2005 | Carroll |
| 2005/0089656 | A1 | 4/2005 | Shiina |
| 2005/0115690 | A1 | 6/2005 | Bohlig |
| 2005/0191112 | A1 | 9/2005 | Yoon |
| 2005/0196580 | A1 | 9/2005 | Provost et al. |
| 2005/0196583 | A1 | 9/2005 | Provost et al. |
| 2005/0208259 | A1 | 9/2005 | Provost et al. |
| 2005/0217092 | A1 | 10/2005 | Barker et al. |
| 2005/0221271 | A1 | 10/2005 | Murphy et al. |
| 2005/0246023 | A1 | 11/2005 | Yeung |
| 2005/0250181 | A1 | 11/2005 | Schroder Glad et al. |
| 2005/0256253 | A1 | 11/2005 | Parker et al. |
| 2005/0265774 | A1 | 12/2005 | Albisetti |
| 2005/0271451 | A1 | 12/2005 | Brand et al. |
| 2006/0002755 | A1 | 1/2006 | Sawa |
| 2006/0002852 | A1 | 1/2006 | Saltzman et al. |
| 2006/0002971 | A1 | 1/2006 | Saltzman et al. |
| 2006/0004193 | A1 | 1/2006 | Muller et al. |
| 2006/0004314 | A1 | 1/2006 | McCarthy et al. |
| 2006/0019339 | A1 | 1/2006 | Lauth et al. |
| 2006/0036269 | A1 | 2/2006 | Schachar et al. |
| 2006/0051274 | A1 | 3/2006 | Wright et al. |
| 2006/0051451 | A1 | 3/2006 | Hutchinson et al. |
| 2006/0051735 | A1 | 3/2006 | Fuhr et al. |
| 2006/0058383 | A1 | 3/2006 | Huang et al. |
| 2006/0062780 | A1 | 3/2006 | Zocher et al. |
| 2006/0063882 | A1 | 3/2006 | Velev et al. |
| 2006/0065992 | A1 | 3/2006 | Hutchinson et al. |
| 2006/0069230 | A1 | 3/2006 | Paplsov |
| 2006/0073159 | A1 | 4/2006 | Vonderheide et al. |
| 2006/0073294 | A1 | 4/2006 | Hutchinson et al. |
| 2006/0073298 | A1 | 4/2006 | Hutchinson et al. |
| 2006/0073333 | A1 | 4/2006 | Anderson |
| 2006/0084034 | A1 | 4/2006 | Hochman |
| 2006/0088897 | A1 | 4/2006 | Lim et al. |
| 2006/0095066 | A1 | 5/2006 | Chang et al. |
| 2006/0099244 | A1 | 5/2006 | Guilford |
| 2006/0106408 | A1 | 5/2006 | Schachar et al. |
| 2006/0106409 | A1 | 5/2006 | Schachar et al. |
| 2006/0110439 | A1 | 5/2006 | Tobia et al. |
| 2006/0115462 | A1 | 6/2006 | Subbolin et al. |
| 2006/0116712 | A1 | 6/2006 | Sepetka et al. |
| 2006/0116713 | A1 | 6/2006 | Sepetka et al. |
| 2006/0121608 | A1 | 6/2006 | Corner et al. |
| 2006/0216103 | A1 | 9/2006 | Bielecki et al. |

FOREIGN PATENT DOCUMENTS

| | | | |
|---|---|---|---|
| DE | 8900030 | U | 5/1990 |
| DE | 3341759 | A1 | 11/1997 |
| DE | 10326926 | A1 | 1/2005 |
| EP | 0 150 557 | | 8/1985 |
| EP | 0267557 | | 5/1988 |
| EP | 0 316 007 | | 5/1989 |
| EP | 0 354 823 | | 2/1990 |
| EP | 0 400 272 | | 12/1990 |
| EP | 0 469 465 | | 2/1992 |
| EP | 0 545 917 | | 6/1993 |
| EP | 0 586 792 | | 3/1994 |
| EP | 0 667 818 | | 8/1995 |
| EP | 0 703 096 | | 3/1996 |
| EP | 0 711 673 | | 5/1996 |
| EP | 0 822 098 | | 2/1998 |
| EP | 0 899 128 | | 3/1999 |

| | | | |
|---|---|---|---|
| EP | 1 050 417 | | 11/2000 |
| EP | 1 354 722 | A2 | 10/2003 |
| EP | 1 600 078 | | 11/2005 |
| GB | 243110 | | 11/1925 |
| GB | 937632 | | 9/1963 |
| GB | 2 325 649 | A | 12/1998 |
| JP | 58009788 | | 1/1983 |
| JP | 60119588 | | 6/1985 |
| JP | 1280596 | | 11/1989 |
| JP | 1281999 | | 11/1989 |
| JP | 2108086 | | 4/1990 |
| JP | 2283499 | | 11/1990 |
| JP | 4043345 | | 2/1992 |
| JP | 04316899 | | 11/1992 |
| JP | 6035232 | | 2/1994 |
| JP | 6216585 | | 8/1994 |
| JP | 07242094 | | 9/1995 |
| JP | 07290883 | | 11/1995 |
| JP | 07329486 | | 12/1995 |
| JP | 8072470 | | 3/1996 |
| JP | 8108676 | | 4/1996 |
| JP | 08216585 | | 8/1996 |
| JP | 8258480 | | 10/1996 |
| JP | 8282174 | | 10/1996 |
| JP | 8282175 | | 10/1996 |
| JP | 9131994 | | 5/1997 |
| JP | 10100579 | | 4/1998 |
| JP | 2003128971 | | 5/2003 |
| JP | 2003312185 | A | 11/2003 |
| JP | 2003312186 | A | 11/2003 |
| JP | 2003312188 | A | 11/2003 |
| KR | 2003056790 | A | 7/2003 |
| KR | 2003060260 | A | 7/2003 |
| KR | 2003061516 | A | 7/2003 |
| WO | WO-90/00118 | A1 | 1/1990 |
| WO | WO-93/12175 | | 6/1993 |
| WO | WO-93/17879 | | 9/1993 |
| WO | WO-94/11204 | | 5/1994 |
| WO | WO-94/11205 | | 5/1994 |
| WO | WO-94/25293 | | 11/1994 |
| WO | WO-95/07191 | | 3/1995 |
| WO | WO-96/39054 | | 12/1996 |
| WO | WO-98/06450 | | 2/1998 |
| WO | WO-99/11471 | | 3/1999 |
| WO | WO-01/28696 | | 4/2001 |
| WO | WO-01/64453 | | 9/2001 |
| WO | WO-02/06437 | | 1/2002 |
| WO | WO-02/13173 | | 2/2002 |
| WO | WO-02/064379 | | 8/2002 |
| WO | WO-03/068530 | | 8/2003 |
| WO | WO-2005/009755 | | 2/2005 |

OTHER PUBLICATIONS

Photograph B, Boone Marker, uncapped.
Photograph C, Colorific Retractable Marker, retracted.
Photograph D, Colorific Retractable Marker, extended.
Photograph E, Marks-A-Lot Retractable Marker, retracted.
Photograph F, Marks-A-Lot Retractable Marker, extended.
Photograph G, Sharpie RT Marker, retracted.
Photograph H, Sharpie RT Marker, extended.
Photograph I, Tokai Retractable Marker, retracted.
Photograph J, Tokai Retractable Marker, extended.
International Search Report corresponding to co-pending International Patent Application Serial No. PCT/US2006/011014; European Patent Office; dated Nov. 23, 2006; 2 pages.

* cited by examiner

SEAL ASSEMBLY FOR RETRACTABLE INSTRUMENT

TECHNICAL FIELD

This disclosure relates generally to seal assemblies for instruments, and, more particularly, to a seal assembly for a retractable instrument, such as a retractable marker.

DESCRIPTION OF RELATED TECHNOLOGY

Capless instruments, such as capless retractable markers, have been developed to solve problems and inconveniences associated with retractable instruments having an outer cap. Such inconveniences include having to use two hands "to uncap and cap a marker pen with the outer cap" and easily losing the outer cap when capping or uncapping an applicator element, e.g., a writing tip. See, e.g., U.S. Pat. No. 6,981,812 to (the '812 patent) (providing a description of problems associated with prior art writing instruments using caps). One capless retractable instrument involves hiding a cover of the capless retractable marker pen within a pen tube, and controlling protraction and retraction of the writing tip by an actuating means installed in a top of the pen tube. Id.

While capless retractable writing instruments have a superior competitive advantage over a marker or pen having an outer cap, capless instruments have several problems. For example, the current sealing elements in retractable instruments are unreliable, as they often do not seal after prolonged use, time, or conditioning. Additionally, such seal assemblies are often unrepeatable, i.e., they do not provide a proper seal after every use. Additionally, "the assembling process is complicated, time-consuming," and difficult "to be sped up in mass production." See, e.g., the '812 patent, col. 2, lines 63-65 (explaining that "the conventional capless retractable marker pens still have many problems requiring solving").

The majority of attempts to solve these problems compromise one or both of the reliability and repeatability of the seal. More specifically, many current designs directly or indirectly rely on contact between an applicator-element assembly, e.g., a nib assembly, and a valve door to force the valve door open from a closed state. However, such contact compromises the reliability of the valve seal in that wear results on both the applicator element and valve door. Additionally, because the applicator element typically deposits fluid upon contact, any interaction between the applicator element and the valve door results in fluid depositing on the sealing features of the valve door. Repeated interaction results in additional fluid depositing on the sealing features, thereby causing degradation of the seal quality to a point where the seal fails and exposes the applicator element to the ambient atmosphere. Build-up of fluid deposits due to continued contact between the applicator element and the valve door can further result in binding or sticking of the applicator element and the reservoir holder assembly during retraction.

More specifically, this fluid accumulation continues to the point where the forces generated by the viscosity of the fluid (or residual components of the fluid) prevent one or both of proper protraction and retraction of the applicator element and reservoir holder components. During retraction, fluid deposits may accumulate within and between an inner wall of a valve body and the outer wall of the tube in the applicator element assembly. During protraction, fluid previously deposited onto the valve door may also be transferred back onto an outer wall of a tube in the applicator element assembly. This transfer of fluid is possible because the valve door, which had contacted the applicator element, continues to remain in contact with the outer wall of the tube after the applicator element forces the door open.

Current designs also rely on a variety of either mechanical or material dependent means of providing a repeatable seal to the retractable instrument, e.g., marker. Each of these methods appears to provide varying degrees of repeatability of the seal. However, the repeatability of the seal designs that rely on the material elasticity to return back to a closed position all suffer from the effects of cycling and aging. For example, after prolonged use and exposure to a variety of conditions, the repeatability of the seal is compromised to a point where the applicator element is exposed to the ambient atmosphere. Designs that rely on mechanical means to provide a repeatable seal appear to provide a more repeatable seal for the retractable instrument; however, the complexity of such designs often results in mechanical failure. See, e.g., U.S. Pat. No. 5,022,773 (the '773 patent). The '773 patent discloses a design having a pliable steel member (24) with a spring clip (22) that provides a closure force for a seal member. This seal member design suffers from the same fluid, e.g., ink, accumulation problems previously described because the writing tip (34) itself forces the spring clip open while pushing through the seal member. Also, the writing tip is often damaged while protracting and retracting through the seal member because of the magnitude of the radial force generated by the spring clip.

SUMMARY OF THE DISCLOSURE

The present invention improves the reliability and repeatability of a seal assembly for a retractable instrument, e.g., a pen, marker, or the like. Specifically, a seal assembly is coupled to an internal instrument assembly, thereby allowing for constrained movement of the seal assembly when the instrument is protracted and retracted.

According to one aspect of the present disclosure, a seal assembly for a retractable instrument comprises a base, at least two fingers attached to the base, and a sleeve partially surrounding the base. When the retractable instrument is in a retracted position, the sleeve constrains the fingers such that the fingers are in a fully closed state, thereby effectively sealing the applicator element of the instrument. Protraction of the base relative to the sleeve allows the fingers to open, thereby exposing the applicator element. The seal assembly may be coupled to an applicator element assembly, allowing the seal assembly and the applicator element assembly to be simultaneously protracted. The base of the seal assembly may further include a flange, such that the flange of the base engages an inner flange disposed on an inside surface of a tube of the retractable instrument.

The seal assembly may further comprise an end seal disposed on the assembly opposite the applicator element for sealing the base. Further, the sleeve of the seal assembly provides a seat for the fingers of the assembly in a retracted position.

Protraction of the base and fingers continues until a stop in the nose of the instrument engages a stop of the sleeve, thereby constraining the protraction of the base and fingers and simultaneously allowing the applicator element to completely protract out of the retractable instrument and into an application position. Further, during retraction of the applicator element, a set of stops disposed on the sleeve engages a set of stops disposed on a body of the instrument, thereby preventing further retraction and allowing the fingers to close around and seal the applicator element.

The seal assembly may further comprise a collet or collet-type valve.

According to another aspect of the present disclosure, a retractable writing instrument comprises a body and a nose disposed at a first end of the body, and an internal writing assembly disposed within the body and including a nib. The retractable writing instrument further includes a seal assembly coupled to the internal writing assembly; the seal assembly comprises a base, at least two fingers attached to the base, and a sleeve partially surrounding the base. When the retractable writing instrument is in a retracted position, the sleeve constrains the fingers such that the fingers are in a fully closed state, thereby effectively sealing the nib. Protraction of the base relative to the sleeve allows the fingers to open, thereby exposing the nib.

According to another aspect of the present disclosure, a retractable instrument comprises a body and a nose disposed at a first end of the body and an internal assembly disposed within the body and including an applicator element. The retractable instrument further comprises a seal assembly coupled to the internal assembly, wherein the seal assembly comprises a base, at least two fingers attached to the base, and a sleeve partially surrounding the base. When the retractable instrument is in a retracted position, the sleeve constrains the fingers such that the fingers are in a fully closed state and seal the applicator element, and protraction of the base relative to the sleeve allows the fingers to open, thereby exposing the applicator element.

BRIEF DESCRIPTION OF THE DRAWINGS

Objects, features, and advantages of the present disclosure will become apparent upon reading the following description in conjunction with one or more of the following figures.

DETAILED DESCRIPTION OF THE DISCLOSURE

Figure 1:
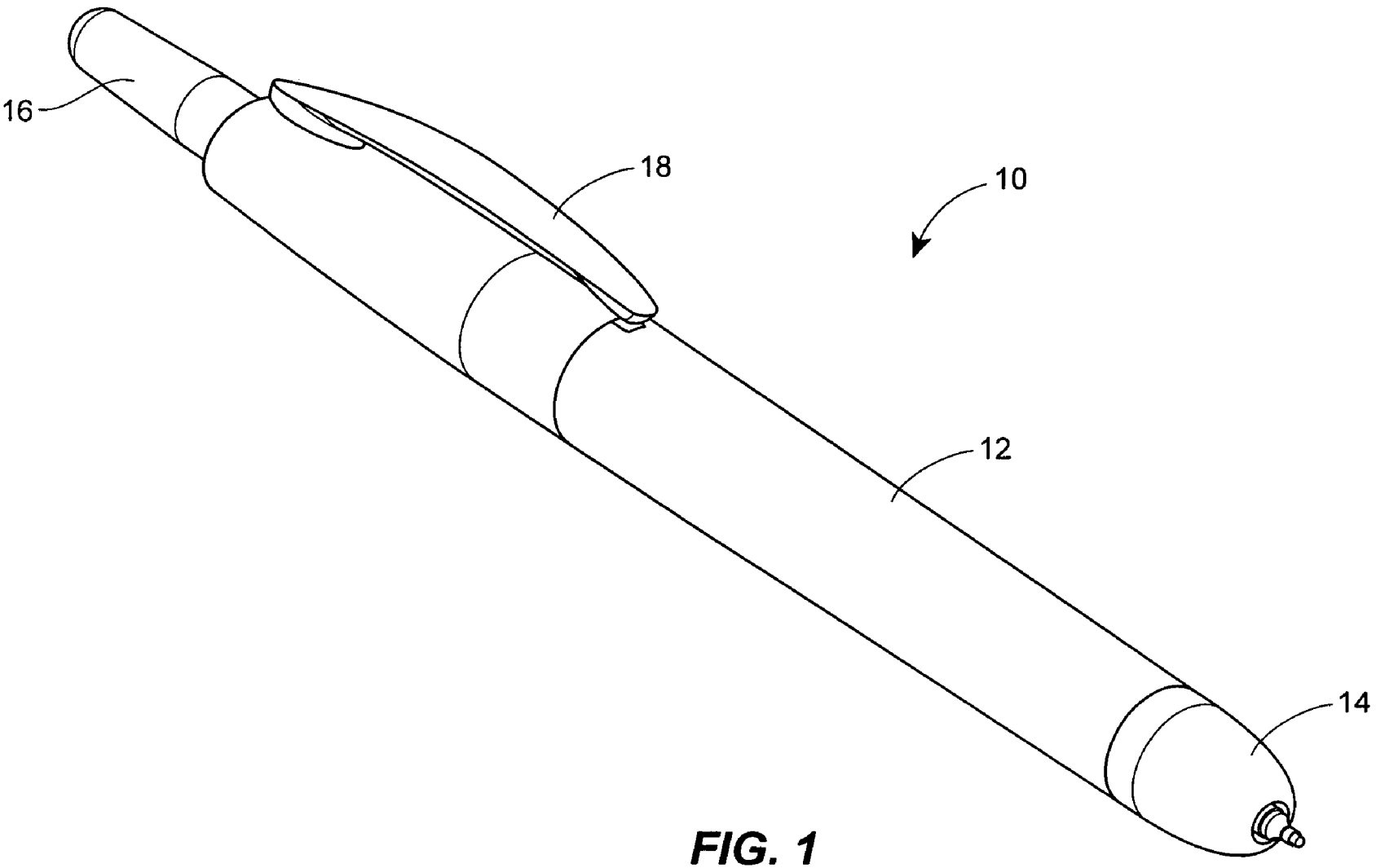
FIG. 1 is a perspective view of a capless retractable instrument in a protracted position having a seal assembly according to the present disclosure.

Referring now to FIG. 1, a retractable instrument 10 is shown. The retractable instrument 10 includes a body 12 and a nose 14, wherein the nose is disposed at a first end of the body 12. A push button or actuator 16 is disposed at a second or actuation end of the body 12, and a clip 18 is disposed on the body 12, as shown, for example, in FIG. 1. More specifically, a well-known knock-type actuation system may be employed that includes a plug having a shaft extending toward the actuation end, and a plunger disposed on the shaft. A spring is disposed between the plunger and the actuator or push button 16. When coupled together, the plug, plunger, spring and actuator or push button 16 provide the well known knock-type actuation system. As is known, by repeatedly pressing the actuator, the actuating system alternately places an applicator element, e.g., a nib, in a retracted position and a protracted or application position, e.g., a writing position. In addition to a knock-type actuation system, other types of actuation systems can be employed. For example, a side button actuation system as shown in U.S. Patent Publication No. 2006-0216103 A1, the disclosure of which is incorporated by reference, can also be used. In this example, the actuator of this disclosure has been replaced with a side actuator extending through a slot in the side wall of the body of the writing utensil or instrument.

Figure 2:
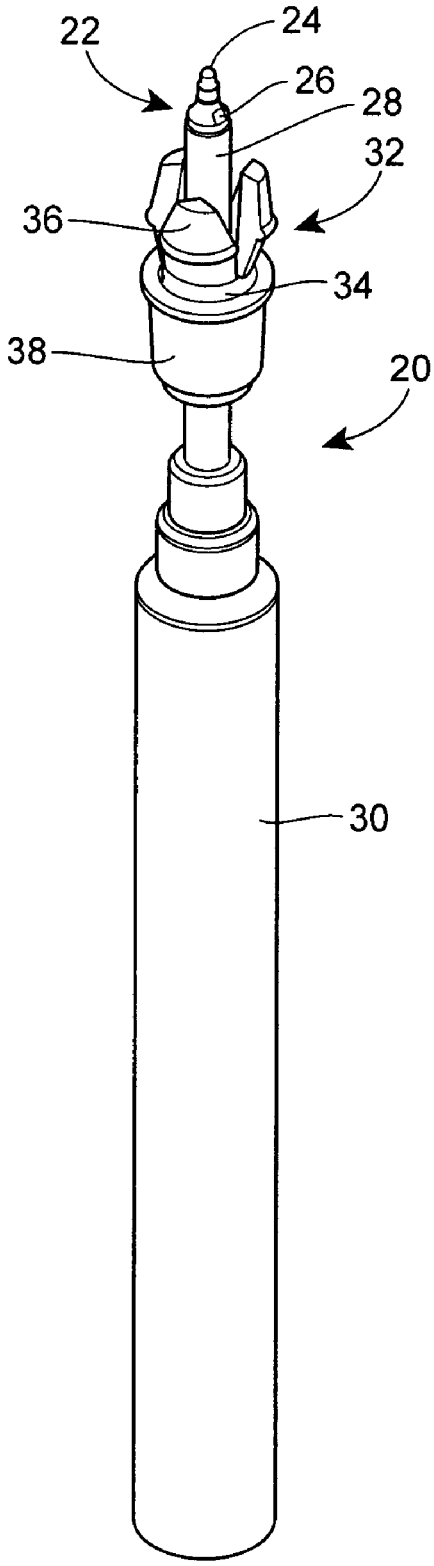
FIG. 2 is a front perspective view of the seal assembly of the present disclosure coupled to an internal instrument assembly.
Figure 3:
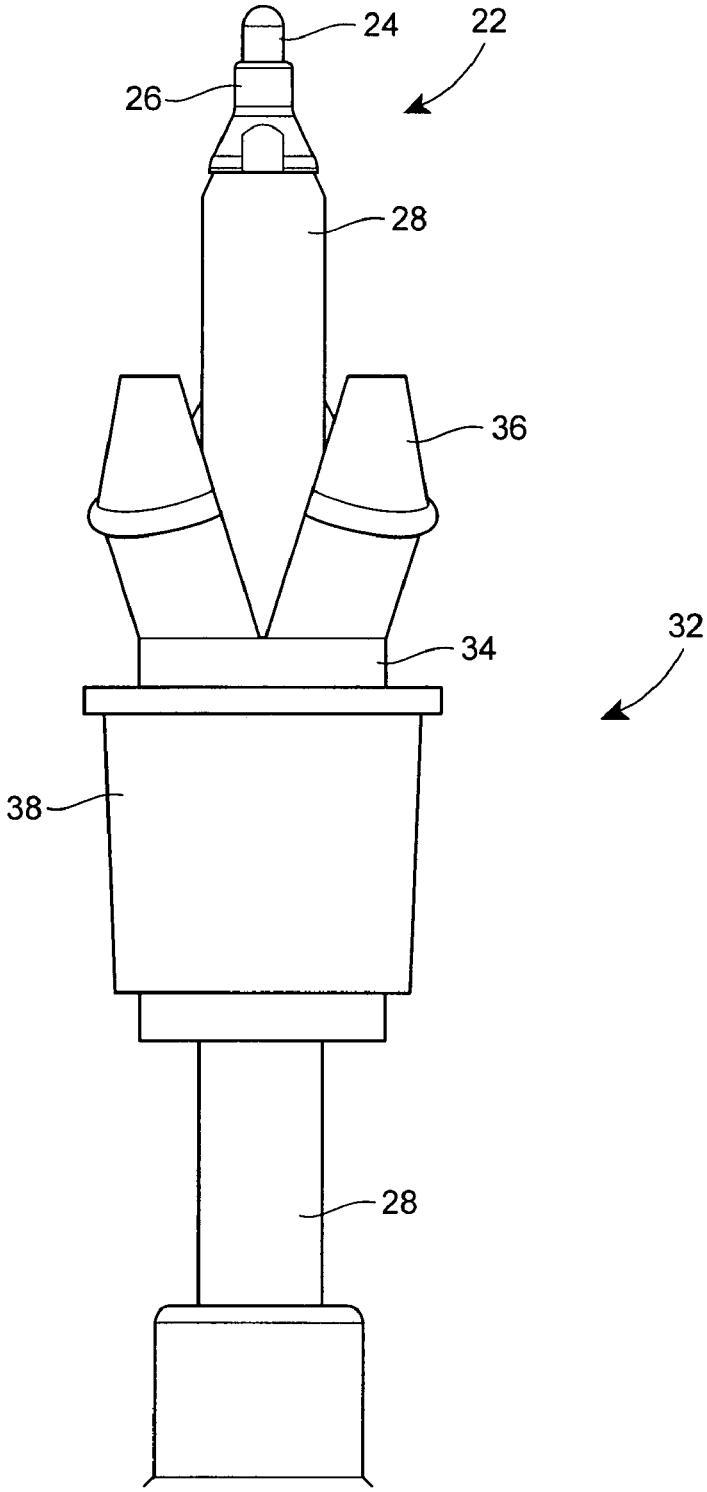
FIG. 3 is a front view of the seal assembly of the present disclosure in a protracted position.

Referring now to FIGS. 2 and 3, the retractable instrument 10 includes an internal instrument assembly 20 (FIG. 2). The internal instrument assembly 20 includes an applicator element assembly 22, which in this embodiment includes a nib 24 and a nib adapter 26, a tube 28, and a reservoir holder 30. A seal assembly 32 is coupled to the internal instrument assembly 20 and includes a base 34, fingers 36, and a sleeve 38. The body 12 houses both the applicator element assembly 22 and the seal assembly 32 when in a retracted position (see FIG. 5). Because the applicator element assembly 22 is linked to the seal assembly 32, the applicator element assembly 22 and the seal assembly 32 are simultaneously protracted and retracted.

Figure 4:
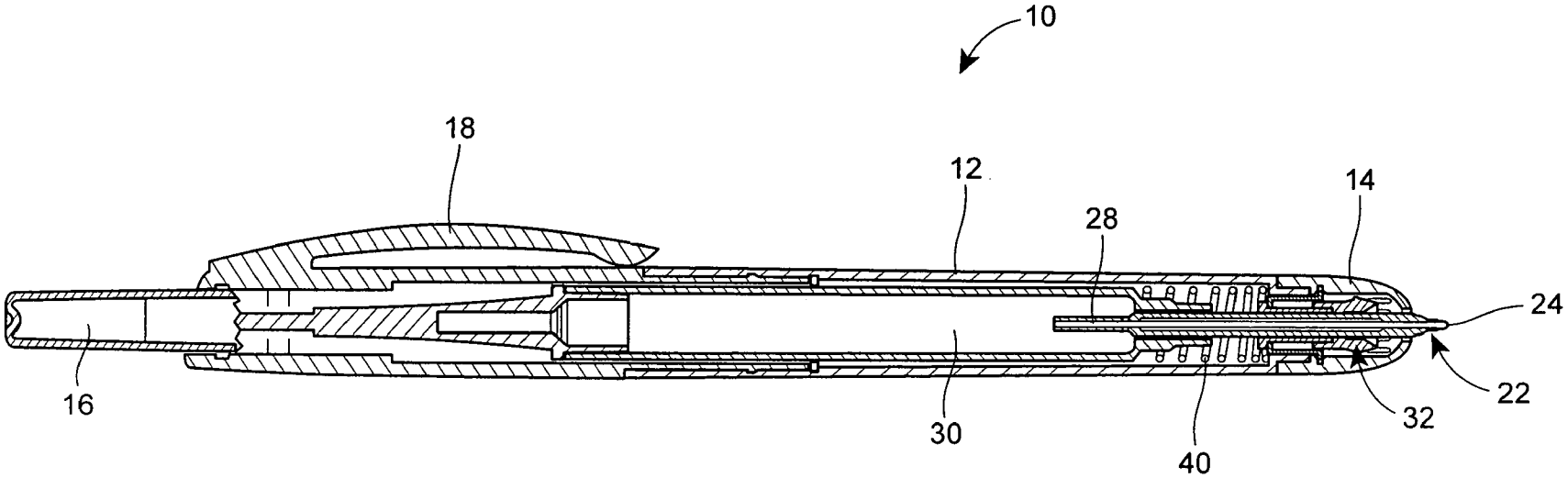
FIG. 4 is a cross-sectional view of the capless retractable instrument of FIG. 1 in a protracted position.

Referring now to FIG. 4, the internal components of the retractable instrument 10 are shown. The seal assembly 32 is coupled to the internal instrument assembly 20 (FIG. 2), e.g., the applicator element assembly 22, the tube 28, and the reservoir holder 30. The reservoir holder 30 provides means to store the fluid, e.g., ink, and the tube 28 holds the application element 24, e.g., the nib, and transfers the fluid from the reservoir holder 30 to the applicator element 24. A spring 40 is also shown. As is well know to those of skill in the art, the actuation of the push button 16 on the body 12 results in the directly linked protraction of the reservoir holder 30, the applicator element 24, the tube 28, and the applicator element adapter 26.

While a single embodiment of retractable instrument 10 is generally shown herein, the retractable instrument 10 can generally be constructed in any of the constructions shown in Brand et al., U.S. Pat. No. 6,964,534 (the '534 patent), the description of which is incorporated by reference. In other words, the seal assembly 32, as detailed below, can be incorporated into any of the writing utensil embodiments shown in the '534 patent with only minor modifications as would be seen by one of skill in the art. Accordingly, the seal assembly 32 can be used in combination with fibrous nibs that allow for fluid ink flow by capillaries formed in a porous reservoir, as is well understood by those of skill in the art. Additionally, the seal assembly 32 can be used in combination with a writing utensil designed as a free ink writing utensil, including those using a porous buffer system, wherein the reservoir is a volume in which the fluid ink is contained. Further, the seal assembly 32 can be used in combination with otherwise conventional ball point pens.

Figure 6:
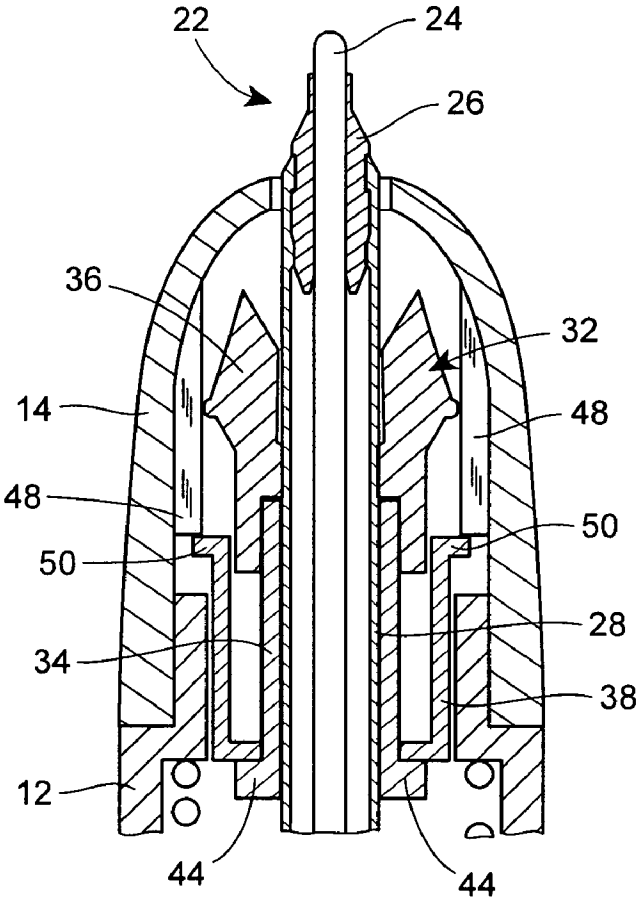
FIG. 6 is a cross-sectional view of the seal assembly of the present disclosure, wherein the partially shown retractable instrument is in a protracted position.
Figure 5:
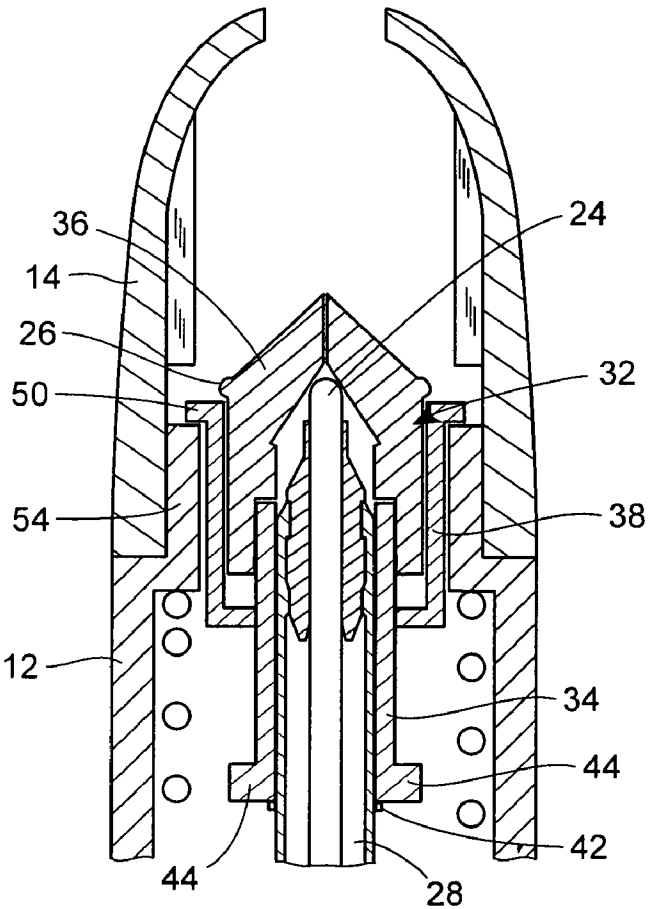
FIG. 5 is a cross-sectional view of the seal assembly of the present disclosure, wherein the partially shown retractable instrument is in a retracted position.

Referring to FIGS. 5 and 6, the base 34, fingers 36, and sleeve 38 of the seal assembly 32 are also incorporated into this protraction through the use of interference flange features incorporated on both the tube 28 and the base 34. More specifically, as shown in FIG. 5, the tube 28 includes a flange 42, and the base 34 also includes a flange 44. The interference flanges 42, 44 are engaged upon the initial protraction of the marker, as shown in FIG. 5.

The seal assembly 32 may also include an additional seal disposed at an end of the assembly opposite the applicator element 24 for sealing the back of the seal assembly 32 against the atmosphere. For example, the end seal may be provided by a seal bead disposed on one or both of an outer wall of the tube 28 and an inner wall of the base 34.

When in a retracted state, the sleeve 38 physically constrains the fingers 36 and also provides a seat. Specifically, interference between the inner wall of the sleeve 38 and the outer surface of the fingers 36 results in the fingers 36 being drawn upon each other to seal the applicator element 24 from the atmosphere.

When protraction begins, the seal assembly 32 is closed until the interference flange 44 of the base 34 contacts the sleeve 38 (FIG. 6) and the interference flanges 42, 44 on the tube 28 and base 34 are overcome. Then the fingers 36 of the seal assembly begin to open and protraction continues until a forward stop 48 on the nose 14 engages a corresponding forward stop 50 of the constrained sleeve 38, thereby constraining the protraction of the base 34 and fingers 36. At this point, the fingers 36 are opened, allowing the applicator element 24, e.g., the nib, to completely protract out of the nose 14 and into an application position. During this process, none of the sealing features of the seal assembly 32 contacts the applicator element 24 to transfer fluid from the applicator element 24, thereby eliminating potential degradation of the seal.

To retract the applicator element 24 back into the body 12, the interference flange 44 on the base and the interference flange 42 of the tube 28 engage, which is caused by a retraction force of the actuation mechanism, e.g., force or pull of the spring. Recall that while the interference flange 44 on the base and the interference flange 42 of the tube 28 are engaged when the applicator element 24 is in a fully retracted position (see, e.g., FIG. 5) the interference flange 42 of the tube 28 overcomes the interference flange 44 of the base during protraction (see, e.g., FIG. 6). Thus, the interference flange 42 of the tube 28 is disposed within or just adjacent to the fingers 36 of the seal assembly 32 (FIG. 6) when the applicator element 24 is in a fully protracted position. As such, when retraction begins the applicator element assembly 22 begins to move back into the body 12 and retraction continues until the stops 50 of the sleeve 38 engage the stops 54 on the body 12 (see FIG. 5), such that the fingers 36 finish closing around the applicator element 24. In other words, the fingers 36 are drawn tightly against each other to form a reliable and repeatable seal. Additionally, when the stops 50 engage the stops 54, the flanges 42, 44 engage and are positioned for the next protraction cycle.

With this design assembly, the seal assembly 32 reliably and consistently seals the applicator element 24 of the instrument from the external environment to prevent dry-out of the applicator element 24 of the writing instrument. Moreover, unlike the current hand-assembly methods of the valve assemblies now used, for example, for markers and the like, the assembly methods for the seal assembly 32 of the retractable instrument 10 described above may be incorporated into a high-speed assembly process without the need for a significant amount of hand-assembly work.

Figure 7:
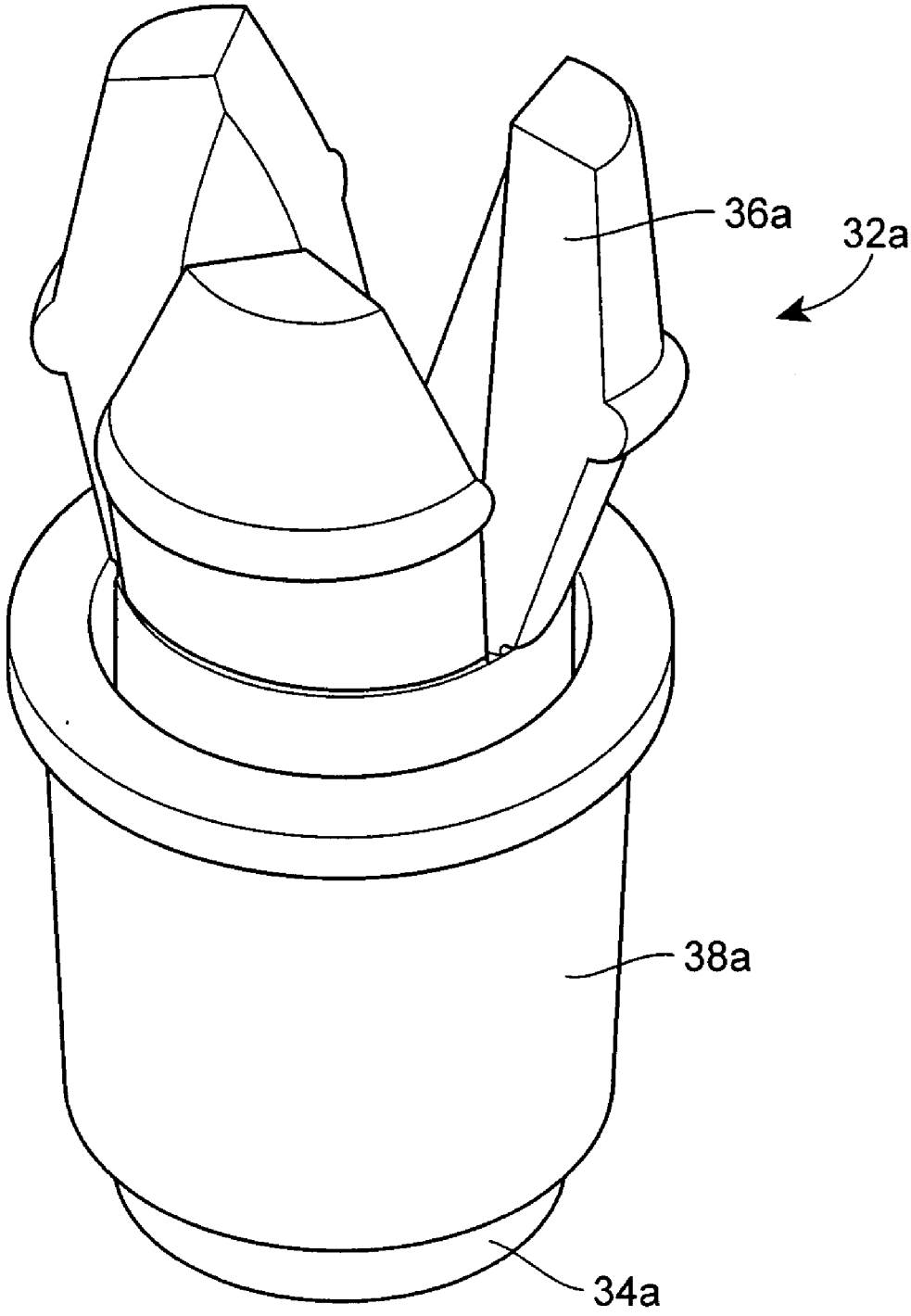
FIG. 7 is a perspective view of the seal assembly of the present disclosure, wherein fingers of the seal assembly are in an open position.
Figure 8:
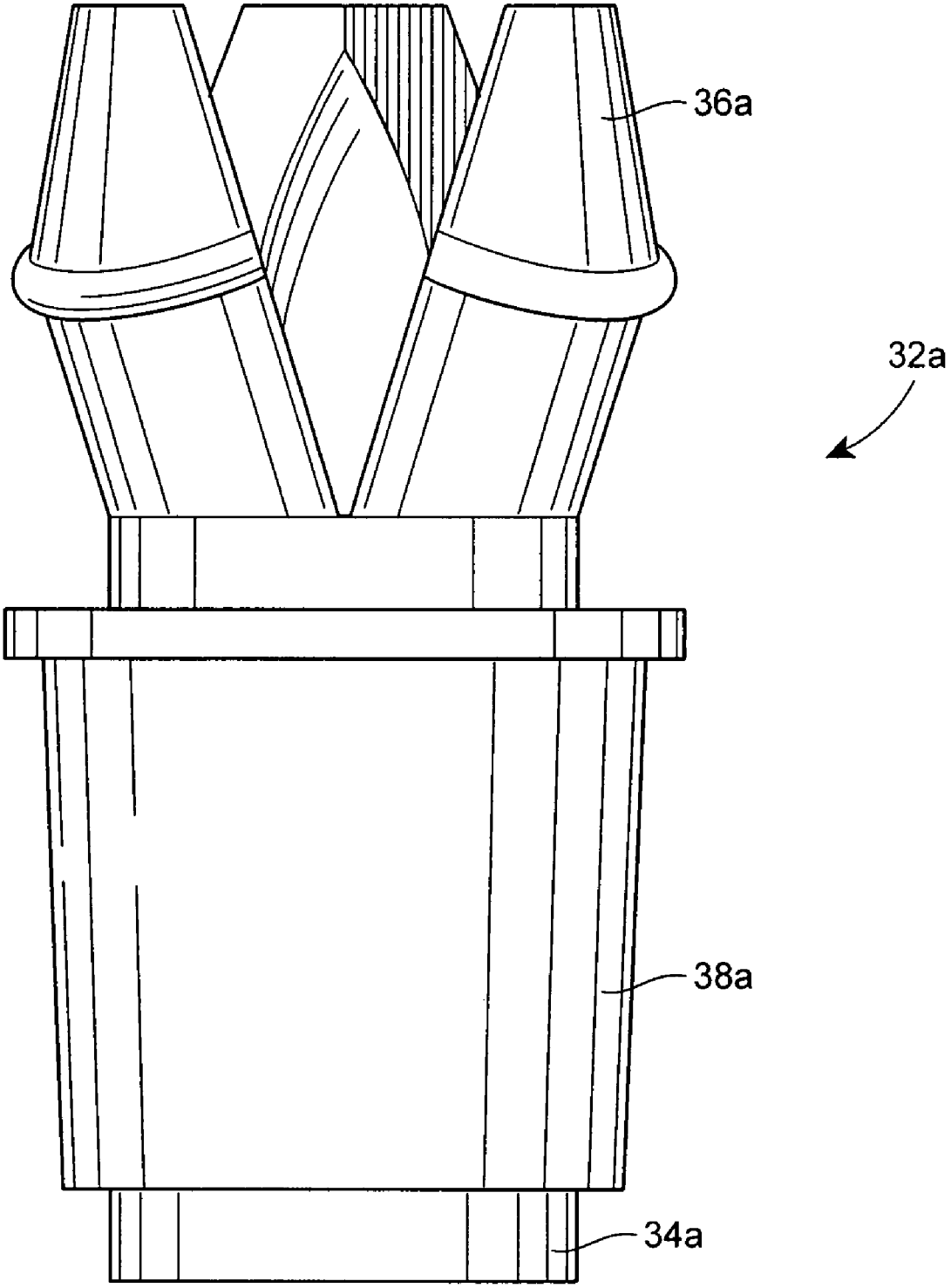
FIG. 8 is a front view of the seal assembly of the present disclosure, wherein fingers of the seal assembly are in an open position.

The seal assembly 32 may be a collet or collet-type valve assembly, as shown, for example, in FIGS. 7 and 8. For example, the collet-type valve assembly 32*a* includes a base 34*a*, fingers 36*a* and a sleeve 38*a*.

Further, the sealing features of the seal assembly 32, such as the fingers 36, may be formed of a variety of materials, such as thermoplastic elastomers, which are also known as TPEs. A thermoplastic elastomer is a material which is both a thermoplastic, i.e., it can be melted and cooled to the same state and an elastomer, i.e., rubbery. Most elastomers are thermosets; in contrast, thermoplastic elastomers are relatively easy to use in manufacturing, for example, by injection molding. Because they can be melted and reused, thermoplastic elastomers have the potential to be recycled, unlike thermosets. See http://en.wikipedia.org/wiki/Thermoplastic elastomer; see also http://www.pslc.ws/mactest/tpe.htm. TPEs include thermoplastic urethanes, which are also known as TPUs. Various TPE products, such as Santoprene® products, may be found at Advanced Elastomer Systems, L.P., in Akron, Ohio, for example.

Other molded parts of the seal assembly 32 and retractable instrument 10 may be formed from thermoplastic polymers. As used herein, thermoplastic polymers generally include synthetic high polymers that soften when exposed to heat and return to their original state when cooled to room temperature. More specifically, thermoplastic polymers include polyvinyl chlorides, nylons, propylene/α-olefin copolymers, polyethylenes, ethylene/α-olefin copolymers, polyurethane prepolymers, polystyrenes such as styrene/ethylene and hydrogenated styrene/butadiene block copolymers, polypropylenes, cellulosic resins, and acrylic resins.

Although certain capless retractable instruments have been described herein in accordance with the teachings of the present disclosure, the scope of coverage of this patent is not limited thereto. On the contrary, this patent covers all embodiments of the teachings of the disclosure that fairly fall within the scope of permissible equivalents. Additionally, as will be appreciated by one of skill in the art, retractable instruments having the seal assembly 32 described above may be used in writing instruments such as highlighters, markers, felt-tipped pens, ball point pens, and the like. In addition to writing instruments, the seal assembly 32 is also applicable to a variety of other retractable instruments including paint brush applicators, correction fluid applicators, make-up applicators, such as nail polish and mascara applicators, perfume applicators, and deodorant applicators.

We claim:

1. A seal assembly for a retractable instrument having an applicator element, the seal assembly comprising:

a base;

at least two fingers attached to the base; and a movable sleeve partially surrounding the base;

wherein, when the retractable instrument is in a retracted position, the movable sleeve constrains the fingers such that the fingers are in a fully closed state and seal the applicator element, and protraction of the base relative to the movable sleeve allows the fingers to open, thereby exposing the applicator element.

2. The seal assembly of claim 1, wherein the seal assembly is linked to a applicator element assembly of the retractable instrument allowing the seal assembly and applicator element assembly to be simultaneously protracted.

3. The seal assembly of claim 1, wherein the base comprises a flange.

4. The seal assembly of claim 3, wherein, in the retracted position, the flange of the base engages a flange disposed on a tube of the retractable instrument.

5. The seal assembly of claim 1, further comprising an end seal disposed on the assembly opposite the applicator element for sealing the base.

6. The seal assembly of claim 1, wherein the sleeve provides a seat for the fingers in the retracted position.

7. The seal assembly of claim 1, wherein, during retraction of the applicator element, a set of stops disposed on the sleeve engages a set of stops disposed on a body of the instrument, thereby allowing the fingers to close around and seal the applicator element.

8. The seal assembly of claim 1, wherein the seal assembly is one of a collet valve or collet-type valve assembly.

9. The seal assembly of claim 1, wherein the retractable instrument is one of a writing instrument, a paint brush applicator, a correction fluid applicator, a make-up applicator, a perfume applicator, and a deodorant applicator.

10. The seal assembly of claim 9, wherein the writing instrument is one of a highlighter, a marker, a felt-tipped pen, and a ball point pen.

11. The seal assembly of claim 9, wherein the make-up applicator is one of a nail polish or a mascara applicator.

12. A retractable writing instrument comprising:

a body and a nose disposed at a first end of the body;

an internal writing assembly disposed within the body and including a nib; and a seal assembly coupled to the internal writing assembly, the seal assembly comprising a base, at least two fingers attached to the base, and a movable sleeve partially surrounding the base; wherein, when the retractable writing instrument is in a retracted position, the movable sleeve constrains the fingers, such that the fingers are in a fully closed state and seal the nib, and protraction of the base relative to the movable sleeve allows the fingers to open, thereby exposing the nib.

13. The retractable writing instrument of claim 12, wherein the internal writing assembly further comprises a nib adapter, a reservoir holder for retaining ink, and a tube for transferring ink from the reservoir holder to the nib.

14. The retractable writing instrument of claim 13, wherein the base comprises a flange, and the tube comprises a flange, such that the base flange and the tube flange are engaged in the retracted position.

15. The retractable writing instrument of claim 12, wherein the seal assembly further comprises an end seal disposed on the assembly opposite the nib for sealing the base.

16. The retractable writing instrument of claim 12, wherein, during retraction of the nib, a set of stops disposed on the sleeve engage a set of stops disposed on the body, thereby allowing the fingers to close around and seal the nib.

17. The retractable writing instrument of claim 12, wherein the seal assembly is one of a collet or collet-type valve assembly.

18. A retractable instrument comprising:

a body and a nose disposed at a first end of the body;

an internal assembly disposed within the body and including an applicator element; and a seal assembly coupled to the internal assembly, the seal assembly comprising a base, at least two fingers attached to the base, and a movable sleeve partially surrounding the base;

wherein, when the retractable instrument is in a retracted position, the movable sleeve constrains the fingers such that the fingers are in a fully closed state and seal the applicator element, and protraction of the base relative to the movable sleeve allows the fingers to open, thereby exposing the applicator element.

19. A seal assembly for a retractable instrument having an applicator element, the seal assembly comprising:

a base;

at least two fingers attached to the base; and a sleeve partially surrounding the base;

wherein, when the retractable instrument is in a retracted position, the sleeve constrains the fingers such that the fingers are in a fully closed state and seal the applicator element, and protraction of the base relative to the sleeve allows the fingers to open, thereby exposing the applicator element, and wherein protraction of the base and fingers continues until a stop of a nose of the instrument engages a stop of the sleeve, thereby constraining the protraction of the base and fingers and allowing the applicator element to completely protract out of the retractable instrument and into an application position.

20. A retractable writing instrument comprising:

a body and a nose disposed at a first end of the body;

an internal writing assembly disposed within the body and including a nib; and a seal assembly coupled to the internal writing assembly, the seal assembly comprising a base, at least two fingers attached to the base, and a sleeve partially surrounding the base;

wherein, when the retractable writing instrument is in a retracted position, the sleeve constrains the fingers, such that the fingers are in a fully closed state and seal the nib, and protraction of the base relative to the sleeve allows the fingers to open, thereby exposing the nib, and wherein protraction of the base and fingers continues until a forward stop of the nose engages a forward stop of the sleeve, thereby constraining the protraction of the base and fingers and allowing the nib to completely protract out of the body and into a writing position.

* * * * *